US008167732B2

(12) United States Patent
Tsai

(10) Patent No.: US 8,167,732 B2
(45) Date of Patent: May 1, 2012

(54) STATIC-BALANCE-EFFECT GAME TABLE

(76) Inventor: Jerry Tsai, Taichung (TW)

( * ) Notice: Subject to any disclaimer, the term of this patent is extended or adjusted under 35 U.S.C. 154(b) by 0 days.

(21) Appl. No.: 12/772,303

(22) Filed: May 3, 2010

(65) Prior Publication Data

US 2011/0266751 A1 Nov. 3, 2011

(51) Int. Cl.
*A63D 15/00* (2006.01)
*A63D 15/04* (2006.01)

(52) U.S. Cl. ..... 473/10; 473/14; 473/16

(58) Field of Classification Search ..... 473/4, 10, 473/9, 14, 15, 16; 108/104, 115; D21/784
See application file for complete search history.

(56) References Cited

U.S. PATENT DOCUMENTS 122,830 A * 1/1872 Heyl ..... 473/14
D11,209 S * 5/1879 Collender ..... D21/784
572,688 A * 12/1896 Seifert ..... 473/14
2,115,115 A * 4/1938 Matteson et al. ..... 473/14
2,546,803 A * 3/1951 Waldon, Sr. ..... 108/104
3,080,193 A * 3/1963 Nimmo ..... 297/158.4
3,572,824 A * 3/1971 Schupbach et al. ..... 297/158.5
3,729,192 A * 4/1973 Nielsen ..... 473/30
3,731,639 A * 5/1973 Schliemann et al. .... 108/157.17
D247,127 S * 1/1978 Kavka ..... D21/318
4,305,581 A * 12/1981 Neuharth ..... 473/15
5,375,837 A * 12/1994 Moreau ..... 473/496
5,501,157 A * 3/1996 Westerburgen ..... 108/115
6,347,797 B1 * 2/2002 Tsai ..... 273/309
6,764,409 B1 * 7/2004 Voden ..... 473/10
6,872,147 B2 * 3/2005 Shih ..... 473/15
2005/0049056 A1 * 3/2005 Padilla ..... 473/10
2005/0104294 A1 * 5/2005 Chen ..... 273/309
2009/0305801 A1 * 12/2009 Chung ..... 473/14

* cited by examiner

*Primary Examiner* — Mitra Aryanpour
(74) *Attorney, Agent, or Firm* — Guice Patents PLLC

(57) ABSTRACT

A static-balance-effect game table includes a table stand and a tablet. The table stand has two frame racks, a reception space, a base component and two connection components. The two frame racks are arranged in a symmetric manner and each has an inner end opposite to each other. Each frame rack includes two frame members individual and symmetric to each other. Each frame member is L-shaped approximately and disposed at an inclined angle, so that a distance between two inner ends of two respective frame members is shorter than a distance between two outer ends of two respective frame members. The reception space is defined between the two frame racks. The base component is elongated and has two opposite ends; each end of the base component connects to the inner end of each frame members. The two connection components join two frame members of each frame rack respectively. The tablet is arranged in the reception space of the table stand, and has two ends joining two connection components respectively.

15 Claims, 6 Drawing Sheets

STATIC-BALANCE-EFFECT GAME TABLE

BACKGROUND OF THE INVENTION

1. Field of the Invention

The present invention relates generally to a game table for users playing and exercising with fun, and more particularly to a game table offering spacious mobile space and static-balance effect.

2. Description of the Related Art

A frame design for a conventional game table usually offers four legs corresponding to corners of the table. To strengthen the structure thereof, a transverse rod or board would be applied for connection between two legs. As illustrated in FIG. 1, a conventional game table 10*a* includes a tablet 20*a* and a table frame 30*a* connected under the tablet 20*a*. The tablet 30 usually is a rectangular frame body, and has at least one game mode surface 22*a*. The table frame 30*a* usually includes four legs 32*a* in accordance with four corners of the tablet 20*a*, a transverse board 34*a* connected two legs located at a terminal end of the table frame 30*a*, and a transverse rod connected two legs located at a lateral side of the table frame 30*a*. The measurement of the table frame 30*a* is confined by the four legs 32*a* and bit smaller than the configuration of the tablet 20*a*; the four legs 32*a* of the table frame 30*a* connect a bottom face of the tablet 20*a* so as to support the tablet 20 thereby.

The conventional game table 10*a* stands on the floor via four legs 32*a*, and the transverse board 34*a* and the transverse rod 36*a* are used to strengthen the structure between the table frame 30*a* and the tablet 20*a*, which means to increase the support stability of the table 10*a*. However, the mobile space for the user, shown in FIG. 1, is restrained because of the transverse board 34*a*; the user could easily get bruised during the movement also because of the transverse board 34*a*.

SUMMARY OF THE INVENTION

It is therefore a primary object of the present invention to provide a static-balance-effect game table, which is benefit of both space efficiency and balance support, the user is offered with spacious mobile space without restraint during a game. Simultaneously, the balance support effect is achieved easily via the simple structure thereof.

To achieve the above object, a static-balance-effect game table including a table stand and a tablet is offered. The table stand has two frame racks, a reception space, a base component and two connection components.

The two frame racks are arranged in a symmetric manner and each has an inner end opposite to each other. Each frame rack includes two frame members individual and symmetric to each other. Each frame member is L-shaped approximately and disposed at an inclined angle, so that a distance between two inner ends of two respective frame members is shorter than a distance between two outer ends of two respective frame members. The reception space is defined between the two frame racks. The base component is elongated and has two opposite ends; each end of the base component connects to the inner end of each frame members. The two connection components connect two frame members of each frame rack respectively. The tablet is arranged in the reception space of the table stand, and has two ends joining two connection components respectively.

Therefore, an open space is formed between the two frame members of each frame rack, so that the greater movement capacity is offered for the user during the game.

As for the movement capacity without restraint, each frame rack is narrow at an inner end thereof and wide at an outer end thereof, which means the configuration thereof is narrow at the inner end and expands to the outer end. The contact area between the table stand and the floor increases due to the L-shaped frame member, so as to strengthen the structure balance.

Besides, the table stand is designed in a symmetric manner, no matter along a longitudinal axis or a latitudinal axis across a center of the table stand. The external force, transmits along the tilting direction of the inclined angle of the frame member, will be conducted and diverged due to the transmissibility of the force in a rigid body.

The present invention can be best understood through the following description and accompanying drawings, wherein:

DETAILED DESCRIPTION OF THE PREFERRED EMBODIMENTS

Figure 1:
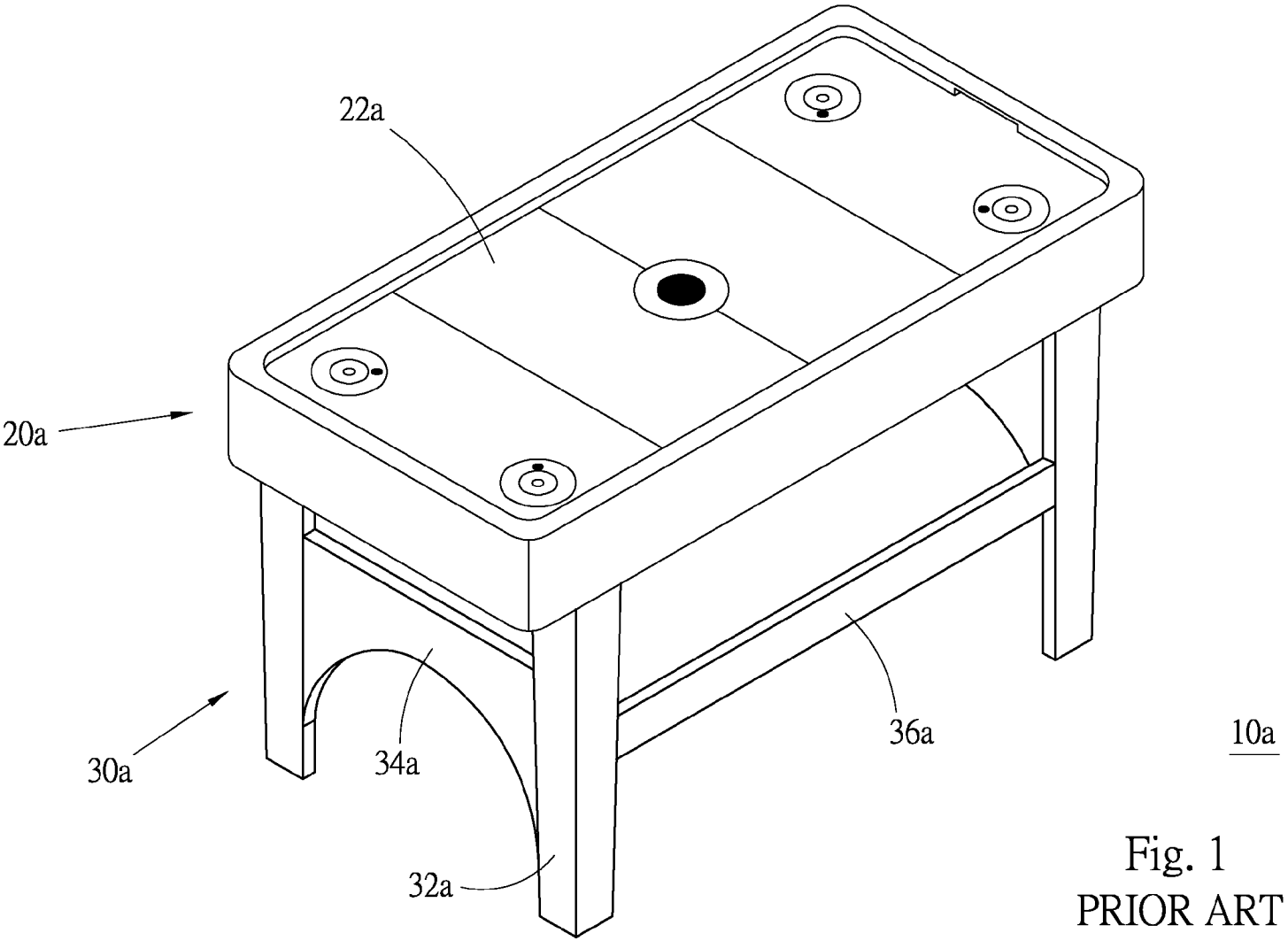
Fig. 1 PRIOR ART
FIG. 1 is a perspective view illustrating a conventional game table.
Figure 2:
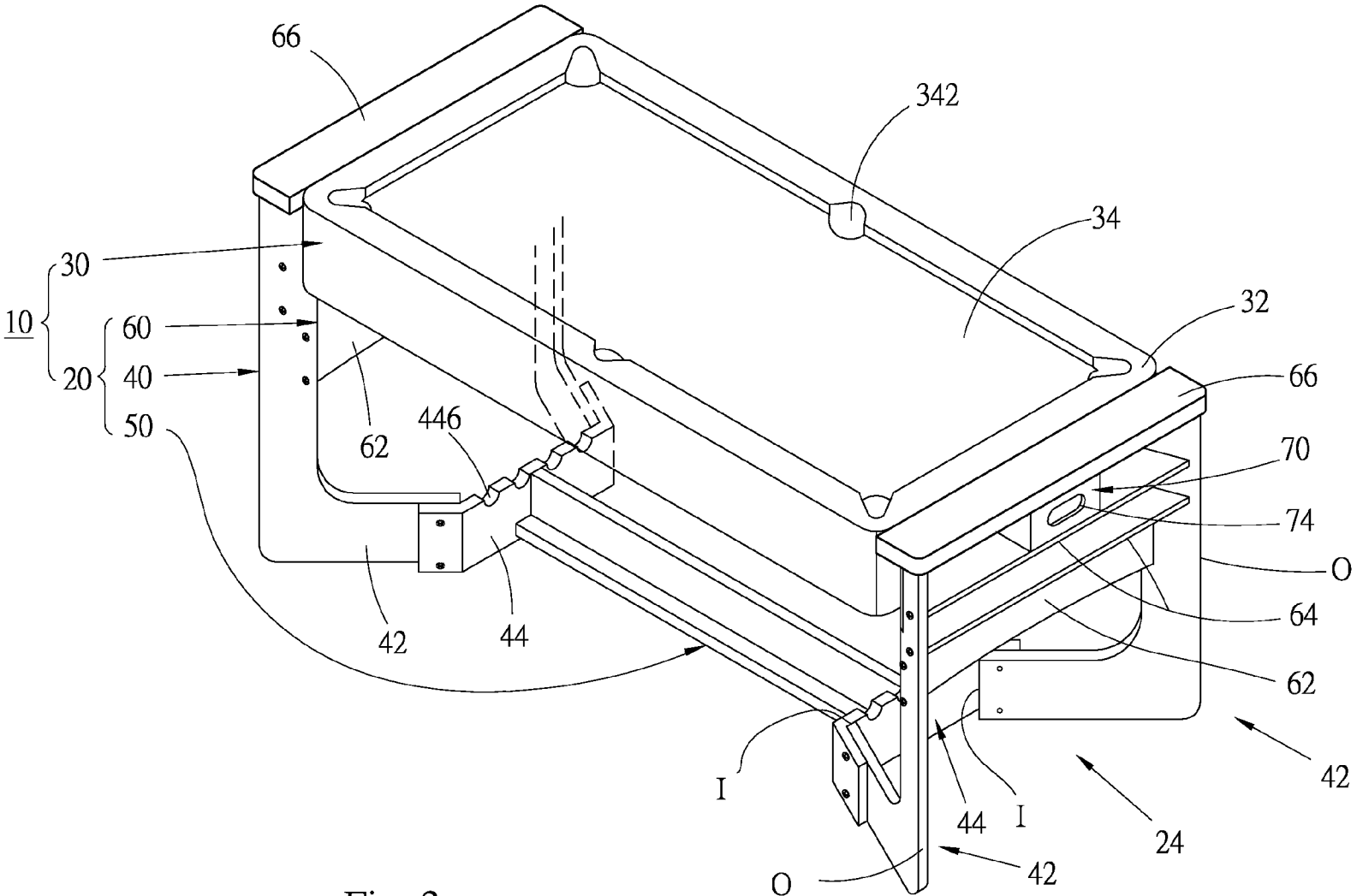
FIG. 2 is a perspective view illustrating a static-balance-effect game table structure according to the preferred embodiment of the present invention.

Please refer to FIG. 2. According to a preferred embodiment of the present invention, a static-balance-effect game table 10 includes a table stand 20 and a tablet 30.

Figure 3:
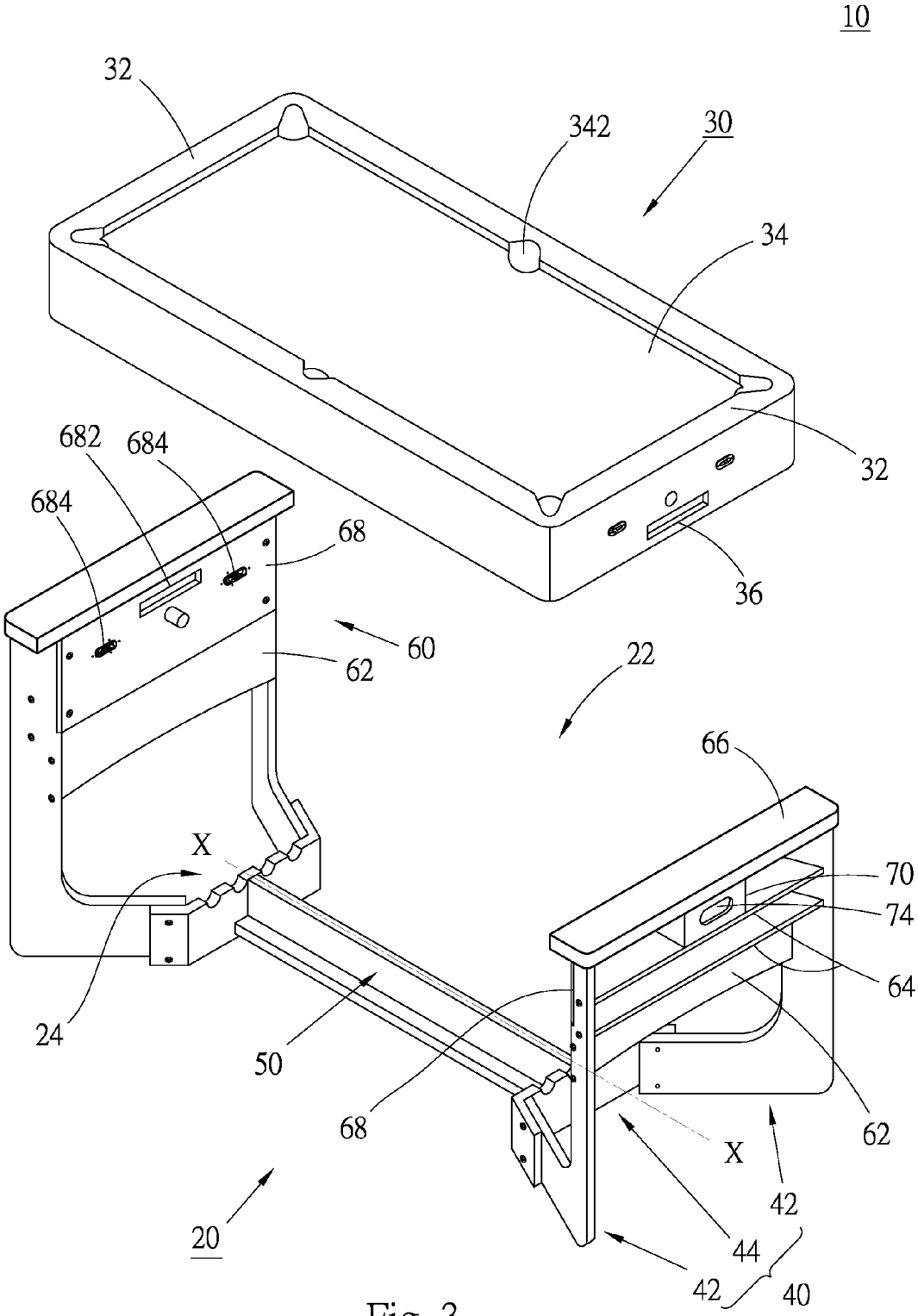
FIG. 3 is a perspective explosion view of a table stand and a tablet according to FIG. 2.

With respect to FIG. 3, the table stand 20 includes two frame racks 40, a base component 50 and two connection components 60. The two frame racks 40 are arranged in a symmetric manner, and each has an inner end opposite to each other. The two inner ends of respective two frame racks 40 are taken as two opposite ends of the table stand 20. The base component 50 is a rod member elongated along a central axis X of the table stand 20. The base component 50 has two opposite ends, and each end of the base component 50 connects to the inner ends of two frame racks 40. A reception space 22 is defined between the two frame racks 40 for allowing the tablet 30 to be arranged therein.

Figure 4:
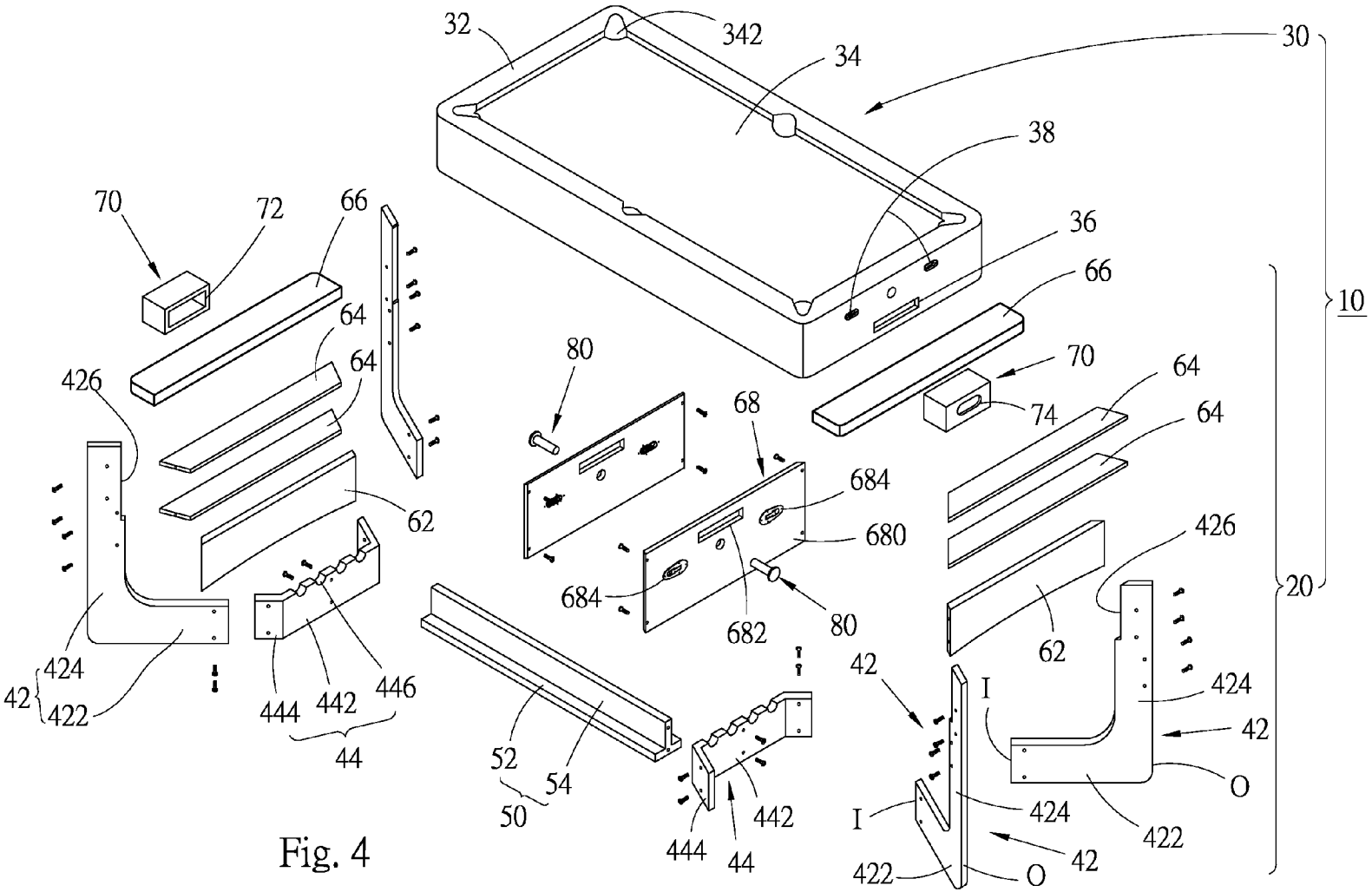
FIG. 4 is a perspective explosion view according to FIG. 2.
Figure 5:
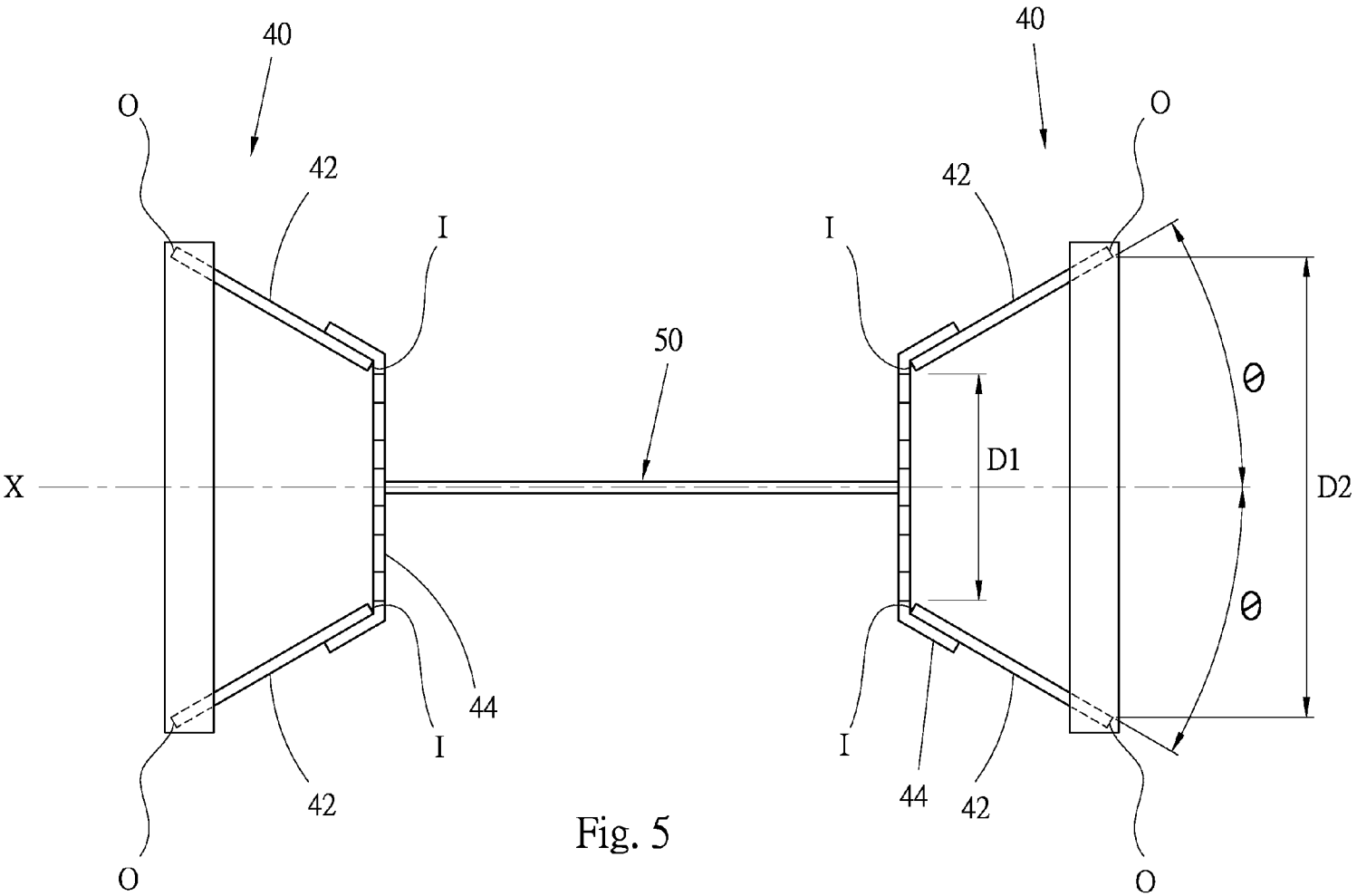
FIG. 5 is a top view of the tables stand according to FIG. 2.

Referring to FIG. 4, the frame rack 40 includes two frame members 42 and a bottom connection member 44 joining two inner ends I of respective two frame members 42. However, as for the condition of the omission of the bottom connection member 44, the support effect of the present invention is also achieved by the base component 50 connecting two inner ends I of respective two frame members 42 directly via two opposite ends thereof. The two frame members 42 are individual and symmetric to each other. Each frame member 42 is L-shaped approximately and disposed at an inclined angle θ shown in FIG. 3. Further referring to FIG. 5, the inclined angle θ of each frame member 42 is defined by tilting outwards from the central axis X of the table stand 20. The inclined angle θ preferably ranges between about 30 and about 45 degrees, so that a distance D1 between two inner ends I of respective two frame members 42 is shorter than a distance D2 between two outer ends O of respective two frame members 42. The configuration of each frame rack 20 is narrow at the inner end and expands to the outer end thereof so as to form an open space 24, which offers a great movement capacity along the central axis X of the table stand 20 for users. In accordance to the preferred embodiment, each frame member 42 is L-shaped approximately. Each frame member 42 includes a base portion 422, and an upright portion 424 extended upwards at a distal end of the base portion 422. A free end of the base portion 422 is considered as the inner end I of each frame member 42. The bottom connection member 44 of each frame rack 40 has a transverse cross section of approximately a U shape. The bottom connection member 44 includes a straight board 442, and two flank boards 444 extending from two lateral sides of the straight board 442 at the inclined angle θ. As for the condition of the omission of the two flank boards 444, the support effect of the present invention is also achieved by the straight board 442 of the bottom connection member 44 connecting two inner ends I of respective two frame members 42 directly via two lateral sides thereof. According to the preferred embodiment, the two flank boards 444 of the bottom connection member 44 join two inner ends I of respective two frame members 42 via screw members. Furthermore, the straight board 442 of the bottom connection member 44 has a plurality of notch portions 446 formed at a top side thereof, while the tablet 30 is designed or altered as a pool table mode 34 or the likes. The notch portions 446 are spaced from one another and could be used for the displacements of the pool sticks (not shown).

Referring FIGS. 2 and 3 again, the two opposite ends of the base component 50 join two inner faces of respective two bottom connection members 44 of the table stand 20. The base component 50 has a base board 52, an erection board 54 disposed along a central axis of the base board 52, and a uniform cross section of an inverted-T shape that is defined together by the base board 52 and the erection board 54. The base component 50, furthermore, is arranged along the central axis X of the table stand 20, so that the two frame racks 40, which connect two opposite ends of the base component 50, is symmetric to each other. The configuration of each frame rack 40 per se is symmetric. Consequentially, the table stand 20 is always considered as a symmetric structure no matter along a longitudinal axis or a latitudinal axis thereof. The inclined angle θ of each frame member 42 of each frame rack 40 results in that the external force will be conducted and diverged due to the transmissibility of the force in a rigid body.

The two connection components 60 join two frame racks 40 to two opposite ends of the tablet 30 respectively; spontaneously, each connection component 60 connect two frame members 42 of each frame rack 40 together. Therefore, the two connection components 60 achieve the connection between the tablet 30 and the table stand 20. Each connection component 60 includes at least one connection board disposed near a top of each frame rack 40; two lateral sides of the connection board is secured to two inner lateral faces of the two frame members 42 respectively. The connection board has a retaining face, which is slant at the inclined angle θ, just fitting to contact to the inner lateral faces of each frame member 42. In this preferred embodiment, the connection component 60 includes one vertical board 62 and two horizontal boards 64, which are secured via screw members.

Each connection component 60 further includes a flange board 66 and a pivotal board 68. The flange board 66 is arranged on the top portion of each frame rack 40 and jointed to each end side 32 of the tablet 30. The extension portion 424 of the frame member 42 of each frame rack 40 has an inlay portion 426 recessed inwardly near a top thereof, so that each lateral side of an exterior face 680 of the pivotal board 68 is able to inset in the inlay portion 426 of each frame member 42 via screw members.

In this preferred embodiment, the flange board 66 is disposed at the topmost of each frame rack 40; the pivotal board 68 is arranged at the inner end but near the top of each frame rack 40; the two horizontal boards 64 are arranged by the exterior face 680 of the pivotal board 68 and below the flange board 66; and the vertical board 62 is disposed beneath the pivotal board 68.

Figure 6:
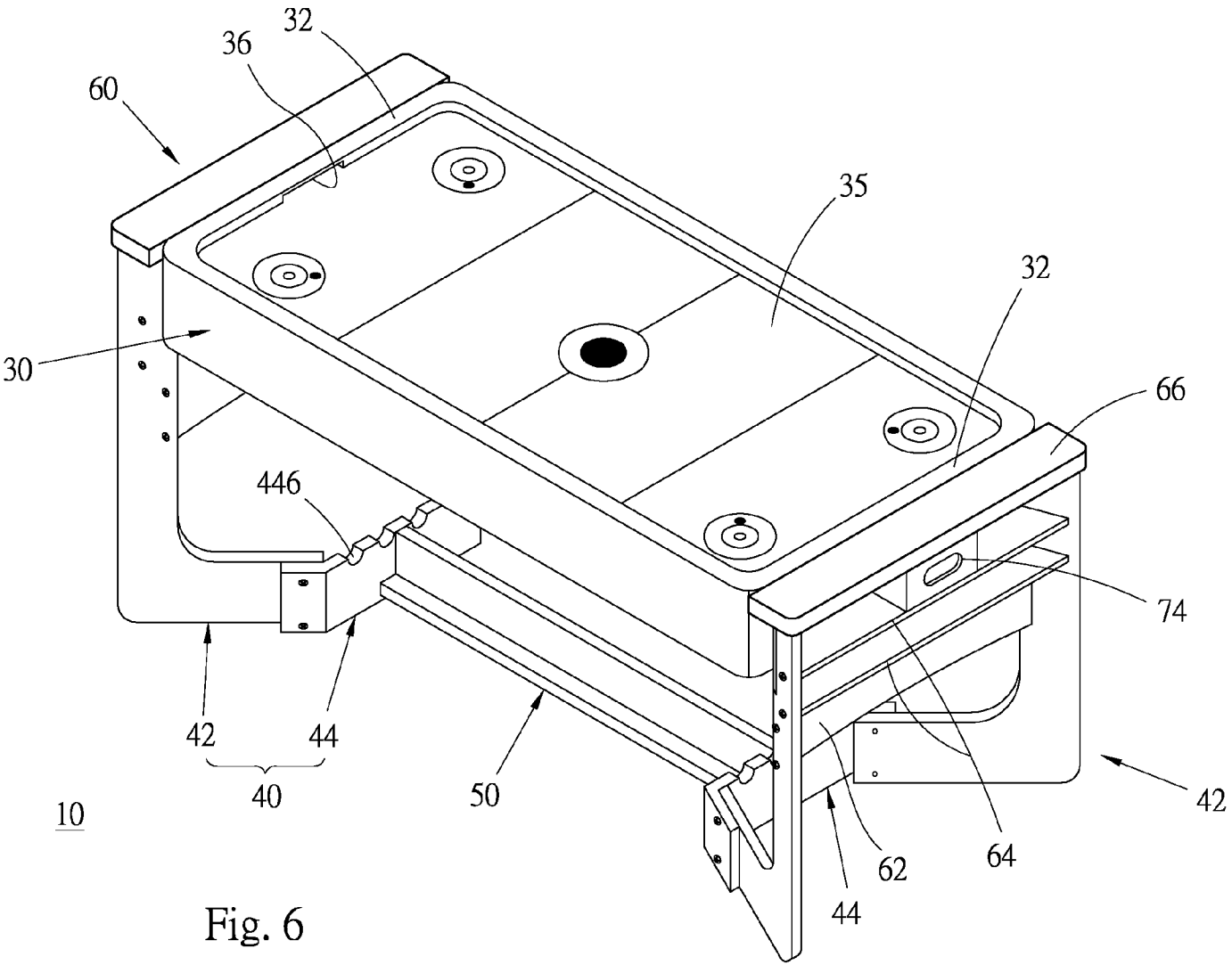
FIG. 6 is a perspective view of the static-balance-effect game table according to the present invention, in which another game mode is altered after the tablet flips.

With respect to FIG. 6, an opposite game mode of the tablet 30 is an ice hockey mode 35. Each end side 32 of the tablet 30 is defined with a slot 36. The pivotal board 68 of each connection component 60 has a through hole 682 communicated the slot 36 of the tablet 30. A collection box 70 is attached to the exterior face 680 of the pivotal board 68, and arranged below the flange board 66 or connected to the flange board 66. The collection box 70 defines an inner opening 72 and an outer opening 74 opposite to each other; the inner opening 72 of the collection box 70 corresponds to and communicates with the through hole 682 of the pivotal board 68. In this preferred embodiment, the tablet 30 and pivotal board 68 each defines a pivot hole (not numbered), and the tablet 30 joins to the pivotal board 68 via a shaft 80 (which is a bolt 80 exactly in the preferred embodiment), so that the tablet 30 could flip in the reception space 22. Therefore, the ball or puck on the game mode surface 34 of the tablet 30 would pass through the slot 36 thereof, the through hole 682 of the pivotal board 68, and the inner opening 72 of the collection box 70 sequentially; and then be collected in the collection box 70 and be further withdrawn via the outer opening 74 of the collection box 70 for the onward game. In addition, each end side 32 of the tablet 30 has two symmetric orientation holes 38; the pivotal board 68 further includes two orientation members 684 corresponding to the orientation holes 38 of the tablet 30. Thus, the two orientation members 684 could latch to secure the tablet 30 after flip.

The static-balance-effect game table is benefit of both space efficiency and balance support. Each frame rack is narrow at the inner end and expands to the outer end thereof, and the open space is offered for the user's move free without restraint. Meanwhile, the contact area between the table stand and the floor increases due to the L-shaped frame member, so as to strengthen the support and balance by simple structure. In addition, the base component is right disposed at the central axis of the table stand; the two frame members are symmetric to each other. Thus, the table stand is always considered as a symmetric structure no matter along a longitudinal axis or a latitudinal axis thereof. Symmetric structure could lead to the good transmissibility of the force in a rigid body, especially because of the inclined angle θ of each frame member of each frame rack. When one frame rack is exerted on the external force, the force will be conducted and diverged to the other frame rack thereby due to the transmissibility characteristics.

The above embodiments are only used to illustrate the present invention, not intended to limit the scope thereof. Many modifications of the above embodiments can be made without departing from the spirit of the present invention.

What is claimed is:

1. A static-balance-effect game table comprising:

a table stand having:

two frame racks arranged in a symmetric manner, and each having an inner end located opposite to each other; each frame rack including two frame members individual and symmetric to each other; each frame member having an L-shape and being positioned at an inclined angle, a distance between two inner ends of respective two frame members is shorter than a distance between two outer ends of respective two frame members, each frame member has a base portion being a bottom portion of the L-shape of the frame member and an upright portion extending upwardly from an end of the base portion, bottom edges of each base portion of each of the two frame members of the two frame racks are located in a common plane supporting the table stand;

a reception space defined between the two frame racks;

a base component being elongated and having two opposite ends; each end of the base component connected to the inner end of each frame members; and two connection components connecting two frame members of each frame rack respectively; and a tablet arranged in the reception space of the table stand and having two ends joining two connection components respectively;

wherein each connection component includes a pivotal board; two lateral sides of the pivot board is secured to the two frame members respectively; the tablet joins to the pivotal board of each connection component via a shaft.

2. The static-balance-effect game table as claimed in claim 1, wherein each frame rack includes a bottom connection member joining two inner ends of respective two frame members; the base component is a rod member elongated along a central axis of the table stand, and the two opposite ends of the base component join two inner faces of respective two bottom connection members.

3. The static-balance-effect game table as claimed in claim 2, wherein the base component has a uniform cross section of an inverted-T shape.

4. The static-balance-effect game table as claimed in claim 2, wherein the bottom connection member of each frame rack has a transverse cross section of approximately a U shape; the bottom connection member includes a straight board, and two flank boards extending from two sides of the straight board at the inclined angle; the two flank boards of the bottom connection member join two inner ends of respective two frame members.

5. The static-balance-effect game table as claimed in claim 4, wherein the straight board of the bottom connection member has a plurality of notch portions formed at a top side thereof; the notch portions are spaced from one another.

6. The static-balance-effect game table as claimed in claim 1, wherein each connection component includes at least one connection board disposed near a top of each frame rack; two lateral sides of the connection board are secured to two inner lateral faces of the two frame members respectively.

7. The static-balance-effect game table as claimed in claim 1, wherein each frame member of each frame rack has an inlay portion formed inwardly near a top thereof, so that each lateral side of the pivotal board is able to inset in the inlay portion of each frame member.

8. The static-balance-effect game table as claimed in claim 1, wherein the pivotal board has a through hole communicated a slot of each end side of the tablet; a collection box is attached to the pivotal board, and defines an inner opening and an outer opening opposite to each other; the inner opening of the collection box corresponds to and communicates with the through hole of the pivotal board.

9. A static-balance-effect game table comprising:

a table stand having:

two frame racks arranged in a symmetric manner, and each having an inner end located opposite to each other; each frame rack including two frame members individual and symmetric to each other; each frame member having an L-shape and being positioned at an inclined angle, a distance between two inner ends of respective two frame members is shorter than a distance between two outer ends of respective two frame members, each frame member has a base portion being a bottom portion of the L-shape of the frame member and an upright portion extending upwardly from an end of the base portion, bottom edges of each base portion of each of the two frame members of the two frame racks are located in a common plane supporting the table stand;

a reception space defined between the two frame racks;

a base component being elongated and having two opposite ends; each end of the base component connected to the inner end of each frame members; and two connection components connecting two frame members of each frame rack respectively; and a tablet arranged in the reception space of the table stand and having two ends joining two connection components respectively;

wherein the inclined angle of each frame member ranges between 30 and 45 degrees by tilting outwards from a central axis of the table stand;

wherein each connection component includes a pivotal board; two lateral sides of the pivot board is secured to the two frame members respectively; the tablet joins to the pivotal board of each connection component via a shaft.

10. The static-balance-effect game table as claimed in claim 9, wherein each frame rack includes a bottom connection member joining two inner ends of respective two frame members; the base component is a rod member elongated along a central axis of the table stand, and the two opposite ends of the base component join two inner faces of respective two bottom connection members.

11. The static-balance-effect game table as claimed in claim 10, wherein the base component has a uniform cross section of an inverted-T shape.

12. The static-balance-effect game table as claimed in claim 10, wherein the bottom connection member of each frame rack has a transverse cross section of approximately a U shape; the bottom connection member includes a straight board, and two flank boards extending from two sides of the straight board at the inclined angle; the two flank boards of the bottom connection member join two inner ends of respective two frame members.

13. The static-balance-effect game table as claimed in claim 10, wherein a straight board of the bottom connection member has a plurality of notch portions formed at a top side thereof; the notch portions are spaced from one another.

14. The static-balance-effect game table as claimed in claim 9, wherein each frame member of each frame rack has an inlay portion formed inwardly near a top thereof, so that each lateral side of the pivotal board is able to inset in the inlay portion of each frame member.

15. The static-balance-effect game table as claimed in claim 9, wherein the pivotal board has a through hole communicated a slot of each end side of the tablet; a collection box is attached to the pivotal board, and defines an inner opening and an outer opening opposite to each other; the inner opening of the collection box corresponds to and communicates with the through hole of the pivotal board.

* * * * *